US010016656B2

(12) United States Patent
Devor et al.

(10) Patent No.: US 10,016,656 B2
(45) Date of Patent: Jul. 10, 2018

(54) AUTOMATICALLY ADJUSTABLE TREADMILL CONTROL SYSTEM

(71) Applicant: OHIO STATE INNOVATION FOUNDATION, Columbus, OH (US)

(72) Inventors: Steven T. Devor, Upper Arlington, OH (US); Cory M. Scheadler, Bethel, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 0 days.

(21) Appl. No.: 15/093,411

(22) Filed: Apr. 7, 2016

(65) Prior Publication Data

US 2016/0296800 A1 Oct. 13, 2016

Related U.S. Application Data

(60) Provisional application No. 62/162,874, filed on May 18, 2015, provisional application No. 62/144,102, filed on Apr. 7, 2015.

(51) Int. Cl.
*A63B 22/02* (2006.01)
*A63B 24/00* (2006.01)

(52) U.S. Cl.
CPC ..... *A63B 24/0087* (2013.01); *A63B 22/02* (2013.01); *A63B 22/025* (2015.10); *A63B 24/0062* (2013.01); *A63B 2024/0093* (2013.01); *A63B 2220/13* (2013.01); *A63B 2220/20* (2013.01); *A63B 2220/803* (2013.01)

(58) Field of Classification Search
USPC ..... 482/54
See application file for complete search history.

(56) References Cited

U.S. PATENT DOCUMENTS 5,314,391 A * 5/1994 Potash ..... A63B 22/0023 340/573.1
5,368,532 A * 11/1994 Farnet ..... A63B 22/02 482/5
5,474,087 A * 12/1995 Nashner ..... A61B 5/1036 482/54

(Continued)

OTHER PUBLICATIONS

Astorino et al., "Incidence of the oxygen plateau at VO2max during exercise testing to volitional fatigue," Journal of Economic Perspective online, 2000, 3(4):1-12.

(Continued)

*Primary Examiner* — Stephen R Crow
(74) *Attorney, Agent, or Firm* — Michael Best & Friedrich LLP

(57) ABSTRACT

Systems and methods are described for automatically adjusting the speed of a treadmill system. The system periodically receives outputs from the range sensor indicative of the position of a user on the treadmill belt. The system calculates an average location when a defined number of outputs have been received, identifies a "zone" corresponding to the average location, and determines a speed adjustment based on the identified zone. After waiting for a defined delay period after receiving the first output of the range sensor, the speed adjustment command is used to adjust the speed of the treadmill motor. The delay period may be defined by the amount of time necessary to receive the defined number of outputs from the range sensor.

18 Claims, 4 Drawing Sheets

(56) References Cited

U.S. PATENT DOCUMENTS

| | | | | | |
|---|---|---|---|---|---|
| 5,690,587 | A * | 11/1997 | Gruenangerl | A63B 22/02 | 482/54 |
| 6,135,924 | A * | 10/2000 | Gibbs | A63B 22/02 | 482/51 |
| 6,179,754 | B1 * | 1/2001 | Wang | A63B 22/0242 | 482/21 |
| 6,645,126 | B1 * | 11/2003 | Martin | A63B 69/0059 | 482/3 |
| 7,101,319 | B1 * | 9/2006 | Potts | A63B 22/0257 | 482/51 |
| 8,002,672 | B2 * | 8/2011 | Brunner | A61B 5/1038 | 482/54 |
| 8,394,002 | B2 * | 3/2013 | Park | A63B 21/0053 | 482/51 |
| 8,480,541 | B1 * | 7/2013 | Brunts | A63B 22/0242 | 482/1 |
| 2009/0036272 | A1 * | 2/2009 | Yoo | A63B 22/0257 | 482/7 |
| 2009/0176629 | A1 * | 7/2009 | Yi | A63B 22/0242 | 482/54 |
| 2016/0213976 | A1 * | 7/2016 | So | A63B 71/0622 | |

OTHER PUBLICATIONS

Astorino et al., "Reinvestigation of optimal duration of VO2max testing," journal of Economic Perspective Online, 2004, 7(6):1-8.
Astorino et al., "Supramaximal testing to confirm attainment of in VO2max sedentary men and women," Int J Sports Med., 2009, 30(4)279-84.
Bassett et al., "Validity of inspiratory and expiratory methods of measuring gas exchange with a computerized system," J Appl Physiol., 2001, 91(1):218-24.
Carter et al., "Oxigen uptake kinetics during supra VO2max treadmill running in humans," Int J Sport Med., 2006, 27 (2):149-57.
Chidnok et al., VO2max is not altered by self-pacing during incremental exercise, Eur J Appl Physiol., 2013, 113 (2):529-39.
Crouter et al., "Accuracy and reliability of the ParvoMedics TrueOne 2400 and MedGraphics VO2000 metabolic systems," Eur J Appl Physiol, 2006, 98(2):139-51.
Eston et al., "Discussion of the efficacy of the self-paced VO2max test to measure maximal oxygen uptake in treadmill running," Appl Physiol Nutr Metab., 2014, 39(5):581-2.
Eston et al., "The effect of antecedent fatiguing activity on the relationship between perceived exertion and physiological activity during a constant load exercise task," Psychophysiology, 2007, 44(5):779-86.
Eston et al., "The validity of predicting maximal oxygen uptake from a perceptually regulated graded exercise test," Eur J Appl Physiol., 2005, 94(3):221-7.
Eston et al., "Use of ratings of perceived exertion in sports," Int J Sports Physiol Perform., 2012, 7(2):175-82.
Evans et al., "Use of perceptually regulated test to measure maximal oxygen uptake is valid and feels better," Eur J Sport Sci., 2014, 14(5)452-8.
Faisal et al., "Prior moderate and heavy exercise accelerate oxygen uptake and cardiac output kinetics in endurance athletes," J Appl Physiol, 2009, 106(5):1553-63.
Faulkner et al., "Prediction of maximal oxygen uptake from the ratings of perceived exertion and heart rate during a perceptually regulated sub-maximal exercise test in active and sedentary participants," Eur J Appl Physiol., 2007, 101 (3):397-407.
Gordon et al., "The effects of exercise modality on the incidence of plateau at VO2max," Clin Physiol Funct Imaging, 2012, 32(5):394-9.
Gurd et al., "Prior heavy exercise elevates pyruvate dehydrogenase activity and speeds O2 uptake kinetics during subsequent moderate-intensity exercise in healthy young adults," J Physiol., 2006, 577(Pt 3):985-96.
Hawkins et al., "Maximal oxygen uptake as a parametric measure of cardiorespiratory capacity," Med Sci Sports Exerc., 2007, 39(1):103-7.
Hodson-Tole et al., "Motor unit recruitment patterns 1: responses to changes in locomotor velocity and incline," J Exp Biol., 2008, 211(Pr 12):1882-92.
Hopkins et al., "Variability of competitive performance of distance runners," Med Sci Sports Exerc., 2001, 33 (9):1588-92.
Jones et al., "Prior heavy exercise enhances performance during subsequent perimaximal exercise," Med Sci Sports Exerc., 2003, 35(12):2085-92.
Joyner et al., "Endurance exercise performance: the physiology of champions," J Physiol., 2008, 586(1):35-44.
Kodama et al., "Cardiorespiratory fitness as a quantitative predictor of all-cause mortality and cardiovascular events in healthy men and women: a meta-analysis," JAMA, 2009, 301(19):2024-35.
Levine et al., "VO2max: what do we know, and what do we still need to know?" J Physiol., 2008, 586(1):25-34.
Mauger et al., "A new VO2max protocol allowing self-pacing in maximal incremental exercise," Br J Sports Med., 2012, 46(1):59-63.
Mauger et al., "The efficacy of the self-paced VO2max test to measure maximal oxygen uptake in treadmill running," Appl Physiol Nutr Metab, 2013, 38:1211-6.
Midgley et al., "Challenging a dogma of exercise physiology: does an incremental exercise test for valid VO2max determination really need to last between 8 and 12 minutes?" Sports Med., 2008, 38(6):441-7.
Midgley et al., "Emergence of the verification phase procedure for confirming 'true' VO2max," Scand J Med Sci Sports., 2009, 19(3):313-22.
Midgley et al., "Verification phase as a useful tool in the determination of the maximal oxygen uptake of distance runners," Appl Physiol Nutr Metab., 2006, 31:541-8.
Miller et al., "Comparison of cardiorespiratory response of moderately trained men and women using two different tradmill protocols," J Strength Cond Res., 2007, 21(4):1067-71.
Minetti et al., "A feedback-controlled treadmill (treadmill-on-demand) and the spontaneous speed of walking and running in humans," J Appl Physiol., 2003, 95(2):838-43.
Myers et al., "Comparison of the ramp versus standard exercise protocols," J Am Coll Cardiol., 1991, 17(6):1332-42.
Noakes, T.D., "Testing for maximun oxygen consumption has produced a brainless model of human exercise performance," Br J Sports Med., 2008, 42(7):551-5.
Noakes, T.D., "The Central Governor Model in 2012: eight new papers deepen our understanding of the regulation of human exercise performance," Br J Sports Med., 2012, 46(1):1-3.
Poole, D.C., Discussion: "The efficacy of the self-paced VO2max test to measure maximal oxygen uptake in treadmill running," Appl Physiol Nutr Metab., 2014, 39(5):586-8.
Pringle et al., "Oxygen uptake kinetics during horizontal and uphill treadmill running in humans," Eur J Apply Physiol., 2002, 88:162-9.
Robergs et al., "Recommendations for improved data processing from expired gas analysis indirect calorimetry," Sports Med., 2010, 40(2):95-111.
Rollo et al., "Repeatability of scores on a novel test of endurance running performance," j Sports Sci., 2008, 26 (13):1379-86.
Rollo et al., "The influence of carbohydrate mouth rinse on self-selected speeds during a 30-min treadmill run," Int J Sport Nutr Exerc Metab., 2008, 18(6):585-600.
Straub et al., "Ramp-incremented and RPE-clamped test protocols elicit similar VO2max values in trained cyclist," Eur J Appl Physiol., 2014, 114(8):1581-90.
Stromme et al., "Assessment of maximal aerobic power in specifically trained athletes," J Appl Physiol., 1977, 42 (6):833-7.
Thompson, W.R., "ACSM's Guidelines for Exercise Testing and Prescription," 8th ed., Philadelphia: Wolters Kluwer Health Lippincott Williams & Wilkins, 2010, p. 23.
Tucker et al., "Non-random fluctuations in power output during self-paced exercise," BR J Sports Med., 2006, 40 (11):12-7.

(56) References Cited

OTHER PUBLICATIONS

Wakeling et al., "Muscle fibre recruitment can respond to the mechanics of the muscle contraction," J R Soc Interface, 2006, 3(9):533-44.
Wilkerson et al., "Influence of initial metabolic rate on pulmonary O2 uptake on-kinetics during severe intensity exercise," Respir Physiol Neurobiol., 2006, 152(2):204-19.
Scheadler, C.M. (2013). Examination of a Self-Selected Speed Graded Exercise Test using an Automated Treadmill as a Valid Means to Measure VO2max (Doctoral dissertation, The Ohio State University). (2013).

* cited by examiner

AUTOMATICALLY ADJUSTABLE TREADMILL CONTROL SYSTEM

RELATED APPLICATIONS

This patent application claims the benefit of U.S. Provisional Patent Application No. 62/144,102, filed Apr. 7, 2015, entitled "VO2MAX MEASURED WITH A SELF-SELECTED WORK RATE PROTOCOL ON AN AUTOMATED TREADMILL," and U.S. Provisional Patent Application No. 62/162,874, filed May 18, 2015, entitled "AUTOMATICALLY ADJUSTABLE TREADMILL CONTROL SYSTEM," the entire contents of both of which are incorporated herein by reference.

BACKGROUND

The present invention relates to systems and methods for controllably adjusting the speed of a treadmill.

SUMMARY

In various embodiments, the invention provides a treadmill control system that simulates "free running" by automatically and smoothly adjusting the speed of a treadmill belt based on a detected location of the runner on the belt. In some embodiments, speed transitions and overall operation of the system are smoothed by implementing a delay period between speed adjustment commands.

In one embodiment, the invention provides an automatically speed-adjusting treadmill system comprising a treadmill belt, a controllable treadmill motor coupled to the treadmill belt, and a range sensor positionable to detect a location of a user positioned on the treadmill belt. The system identifies a location of the user in one of a plurality of zones based on an output of the range sensor The plurality of zones include a middle zone, two or more deceleration zones behind the middle zone, and two or more acceleration zones in front of the middle zone. A speed adjustment command is determined based on the identified zone in which the user is located. The magnitude of the speed adjustment command is greater in zones farther from the middle zone. The speed of the treadmill motor is adjusted based on the speed adjustment command after waiting for a defined delay period after receiving the output of the range sensor.

In some embodiments, the system periodically receives outputs from the range sensor and calculates an average location when a defined number of outputs have been received. A zone is then identified that corresponds to the average location of the user. In some such embodiments, the delay period is defined by the amount of time necessary to receive the defined number of outputs from the range sensor.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
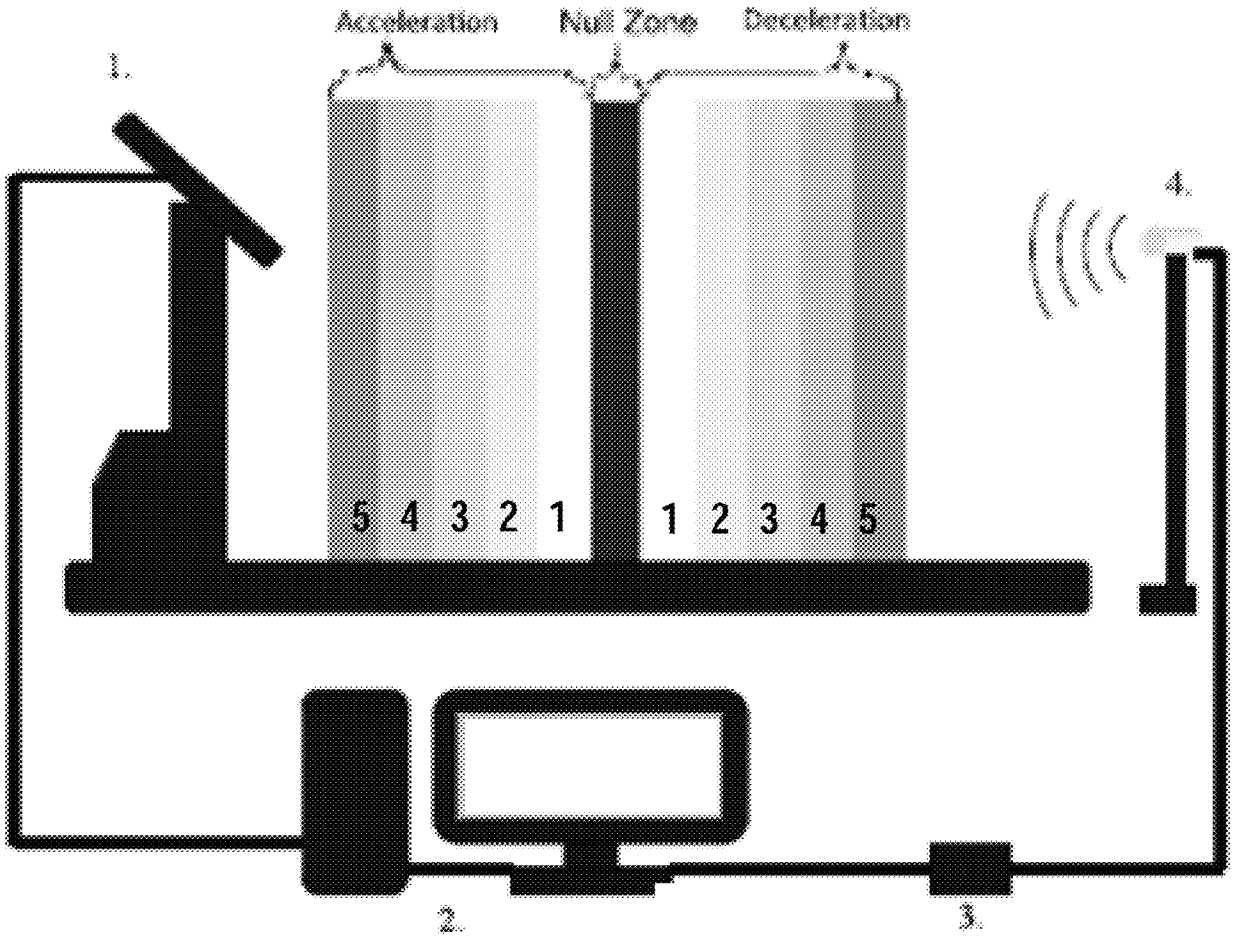
FIG. 1 is a block diagram of a treadmill control system according to one embodiment.

FIG. 1 illustrates the components of a system for automatically controlling the speed of a treadmill 1. The speed control system and user interface of the treadmill 1 itself is coupled to a computer system 2. The computer system 2 is communicatively coupled to a microcontroller which operates and monitors a sonar range finder 4. The sonar range finder 4 (e.g., a MaxSonar EZ1 manufactured by MaxBotix, Inc. in Brainerd, Minn.) identifies the location of a user on the treadmill and has a resolution of approximately 2.54 cm. The size of the voltage output by the range finder 4 is dependent on the distance of the subject from the range finder. The microcontroller 3 (e.g., an Auduino UNO from Smart Products in Italy) converts the voltage from the sonar range finder 4 into a digital signal and communicates the digital signal to the computer system 2 via a USB cable.

Computer software running on the computer system 2 determines an appropriate speed adjustment command based on the digital signal from the microcontroller 3 and communicates the speed adjustment command to the treadmill controller (e.g., a Trackmaster TMX425C from Full Vision Inc of Newton, Kans.) via an RS-232 cable. The treadmill set speed is then adjusted accordingly and the treadmill is accelerated or decelerated toward the new set speed. As described in further detail below, there may be a time delay of approximately 1 second between the time that the range finder 4 senses a change in position and the time when the speed adjustment command is transmitted to the controller of the treadmill 1.

Although the example of FIG. 1 (and further examples discussed below) may show the functionality of the treadmill system distributed between various different modules (i.e., a computer system 2, a treadmill controller 1, and a microcontroller 3), in some implementations, the treadmill system may include more or fewer components. For example, in some implementations, the treadmill controller directly monitors the sonar range finder and determines an appropriate speed adjustment based on the output of the range finder. In other implementations, the system includes a "retro-fit" add-on that houses a range finder and outputs an appropriate speed adjustment command to an existing treadmill controller/system via an RS-232 cable or other wired or wireless communication mechanism.

Furthermore, although the example of FIG. 1 includes a sonar range finder sensor 4 positioned behind a runner, other implementations may use a different type of range finder sensor (e.g., LIDAR) or may position the range finder at a different location relative to the user. For example, in some implementations the range finder sensor may be integrated into the user interface console of the treadmill in front of the user. In some implementations, it may be beneficial for the range finder to target a specific part of the user's anatomy. For example, the chest movement of a runner may lead whole body movement in that a runner may tend to lean forward slightly when increasing speed and may tend to stand more upright when slowing. Therefore, a range finder positioned in front of the user and targeted toward the user's chest may improve responsiveness of the system described below. Similarly, because some treadmill systems are intended to accommodate multiple users of various heights, the range finder in some implementations may be mounted on a telescoping mechanism to raise or lower the height of the range finder to target an optimal anatomical structure of the runner. In other implementations, the system may include a mechanically controllable or manually operable pivot mechanism to change the angle of the range finder sensor 4 to accommodate users of various heights.

Several zones are defined along the belt of the treadmill 1 to provide for appropriate incremental accelerations and decelerations in speed. In the example of FIG. 1, the operating area of the treadmill 1 is divided into 11 zones—null zone, five acceleration zones in front of the null zone, and five deceleration zones behind the null zone. If the computer system 2 determines, based on the output signal from the sonar range finder 4, that the user is currently positioned in the null zone, then no speed adjustment command will be output to the controller of the treadmill 1. However, if the output of the range finder 4 indicates that the user is positioned in one of the acceleration zones or one of the deceleration zones, the computer system 2 will output a speed adjustment command increasing or decreasing the speed of the treadmill 1, respectively.

As a result, if the user has increased his speed and is now moving toward the front of the treadmill belt, the sonar range finder detects the change in position and the system increases the speed of the treadmill belt to return the runner to the "null zone" (i.e., near the "middle" of the treadmill). Similarly, if the user slows his speed and is now moving towards the rear of the treadmill belt, the sonar range finder detects the change in position and the system decreases the speed of the treadmill belt to return the runner to the "null zone."

In the example of FIG. 1, each zone of the 11 zones is 7.6 cm wide. In order from the null zone to the front of the treadmill, acceleration zones increased speed in increments of 0.16, 0.32, 0.64, 1.6, and 3.2 km/h. Similarly, the speed adjustment output for each deceleration zone (in order of distance from the null zone) is 0.16, 0.32, 0.64, 1.6, and 3.2 km/h. The magnitude of the speed adjustment command is based on the distance between user and the null zone. For example, the magnitude of the speed adjustment command will be smaller if the user is positioned just behind the null zone and will be relatively larger if the user is positioned near the end of the belt of the treadmill.

However, the number of zones, the width of zones, and the speed adjustment for each zone can be modified in various implementations based on variables such as, for example, the size of the treadmill belt, the current speed of the treadmill, and user preferences. For example, the automated treadmill system of FIG. 1 may be adapted for use with a "walking desk." A walking desk positions a treadmill surface proximate to a work surface (i.e., a desk) such that the user can walk while working. In most cases, a walking desk user will not be sprinting, but rather will be walking or jogging at a slower pace. Therefore, the speed adjustment increments assigned to each zone may be smaller than those discussed above in reference to FIG. 1.

Furthermore, the number of zones may be increased and the size of each zone correspondingly decreased to allow the treadmill (either in the "walking desk" implementations or in other "exercise" settings) to be more sensitive to variations in user speed. For example, when the treadmill belt is moving at a relatively slow speed to accommodate a user at a slow walking speed, the system may adjust to utilize only three zones: the null/middle zone (where the speed of the belt will not be altered), a forward/acceleration zone (where the speed of the belt will be increased), and a rear/deceleration zone (where the speed of the belt will be decreased). In some such implementations, the system operates using only these three zones until the speed of the treadmill belt exceeds a first threshold. At that time, the system adjusts to utilize five zones (i.e., the middle zone, two forward/acceleration zones, and two rear/deceleration zones). Similarly, in some implementations, when a second threshold speed is exceeded, the system again adapts to utilize seven zones (i.e., the middle zone, three forward/acceleration zones, and two rear/deceleration zones) and so on continuing to increase the number of zones (and, thereby, the specificity of the speed adjustment mechanism) as the speed of the treadmill belt continues to increase beyond other defined speed thresholds.

In other implementations, the size/width of each zone changes gradually in inverse proportion to the speed of the treadmill belt (i.e., the size of each zone decreases as the speed of the belt increases and increases as the speed of the belt decreases). In various such embodiments, the null zone may be of a static size or may also adjust with the speed of the belt. In some such implementations, a new zone is introduced when the current number of zones at their current defined size is no longer able to cover the entire range of motion on the treadmill belt. For example, a system may start with three zones including the null/middle zone, the forward/acceleration zone, and the rear/deceleration zone. As the speed of the treadmill increases, the forward/acceleration zone and the rear/deceleration zone decrease in size causing two new zones to be introduced—one beyond the front edge of the forward/acceleration zone and the other beyond the rear edge of the rear/deceleration zone. When initially introduced, these new zones may be smaller than the current size of the original zones based on the available operating area on the treadmill belt.

As the speed of the treadmill belt continues to increase and the size of the zones continues to correspondingly decrease, the two new zones will eventually "fit" within the operating area of the treadmill belt and two further additional zones will be introduced at the rear and front edges of the treadmill belt. At this point, in some implementation, the two early forward/acceleration zones are now the same size and continue to decrease in size correspondingly while the new third forward/acceleration zone continues to increase in size as space permits. This continues until the third forward/acceleration zone also reaches the same size as the two earlier forward/acceleration zones and a new fourth forward/acceleration zone is then introduced at the front edge of the treadmill belt.

In other implementations, the speed adjustment increments assigned to each zone may be variable based on the current operating speed of the treadmill belt. For example, a 3.2 km/h adjustment may be appropriate when a user is running at 15 km/h and is approaching one of the extreme zones. However, a 3.2 km/h adjustment would not be appropriate for a user walking at 3 km/h. Therefore, in some implementations, the system is designed to assign a speed adjustment increment to each zone as a function of the current speed of the treadmill belt. In other implementations, the speed adjustment increments are assigned to each zone based on a series of operating speed thresholds (i.e., when the speed of the treadmill belt is in a first operating range, a first set of speed adjustment increments is applied; when the speed of the treadmill belt is in a second operating range, a second, higher set of speed adjustment increments is used).

Furthermore, although the zones generally all have the same size/width in the examples discussed above, the dimensions of the various zones can be defined such that they have different widths in some implementations. For example, in some implementations, the acceleration and deceleration zones closer to the middle/null zone may be smaller than the acceleration and deceleration zones closer to either end of the treadmill belt. In such configurations, the speed adjustment mechanism operates with more specificity (e.g., a greater number of smaller zones) when the user is positioned neared to the middle/null zone and may require less specificity (e.g., a smaller number of larger zones) when the user's position deviates from the middle.

In some implementations, the system may provide a user interface that allows the user to specify a zone configuration and to select a particular dynamic zone size/speed adjustment protocol based on the user's preference or the particular purpose/type of activity.

Figure 2:
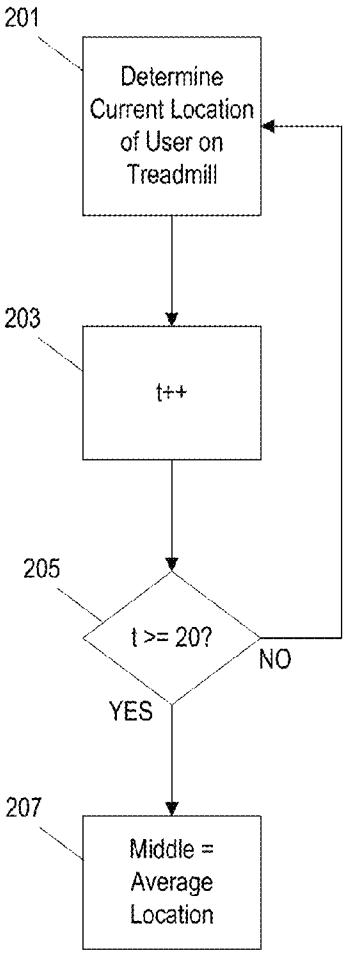
FIG. 2 is a flow chart of a method for determining a location of a "null zone" on a treadmill for the treadmill control system of FIG. 1.

Some implementations also enable the user to adjust or set the location of the middle or "null zone." FIG. 2 illustrates one example of how the location of the "null zone" is set by the system of FIG. 1. A user either stands on the treadmill or walks at a comfortable speed in a location that is comfortable to the user. The computer system determines the current location of the user (step 201) based on the output of the sonar and increments a counter (step 203) until a total of 20 location readings are received (step 205). Once 20 location readings are received, the system averages the received location values and uses the average user location as the position of the "null zone" (step 207) for the current session. This initialization process can be repeated at the beginning of each session or can be stored as part of a user-specific profile. Furthermore, although the example of FIG. 1 uses an average of 20 location readings, other implementations may utilize more or few location readings to determine the position of the "null zone."

Figure 3:
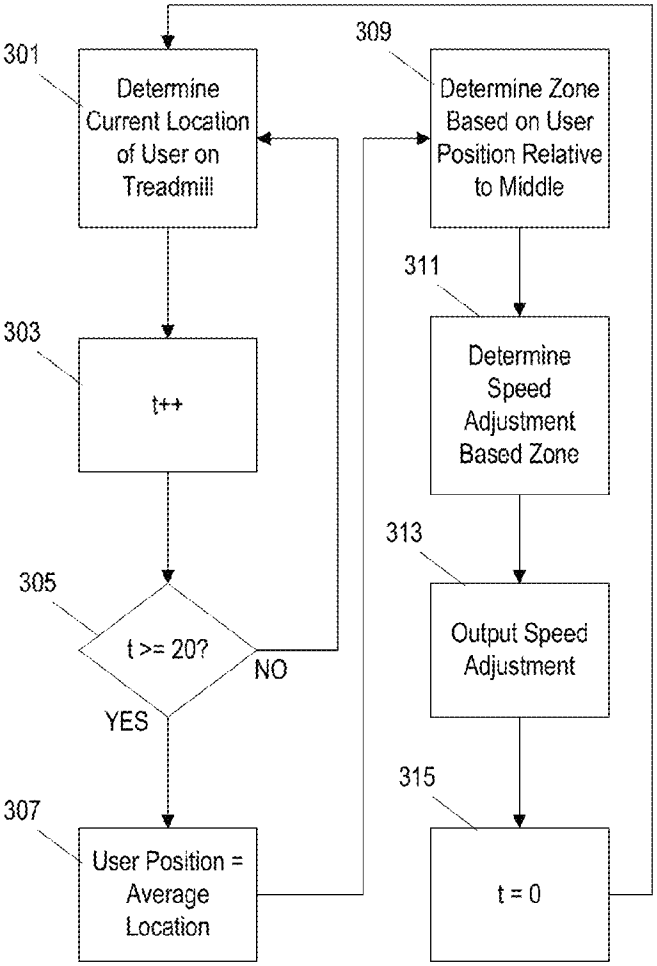
FIG. 3 is a flow chart of a method for determining a speed adjustment for the treadmill control system of FIG. 1 based on a detected location of the user relative to the "null zone."

FIG. 3 illustrates a first example of how the computer system determines an appropriate speed adjustment based on the location of the user. Like during the "initialization" procedure of FIG. 2, the system begins by determining a current location of the user (step 301) and increments a counter (step 303) until a total of 20 location readings are received (step 305). The system then computes an average of the 20 location readings (step 307) and identifies a zone corresponding to the average location (step 309). The system determines the appropriate speed adjustment corresponding to the identified zone (step 311) and outputs the speed adjustment command (step 313) to the treadmill controller. The system then resets the counter (step 315) and begins receiving another set of 20 locations that will be used to determine another "average location" and yet another speed adjustment output.

Figure 4:
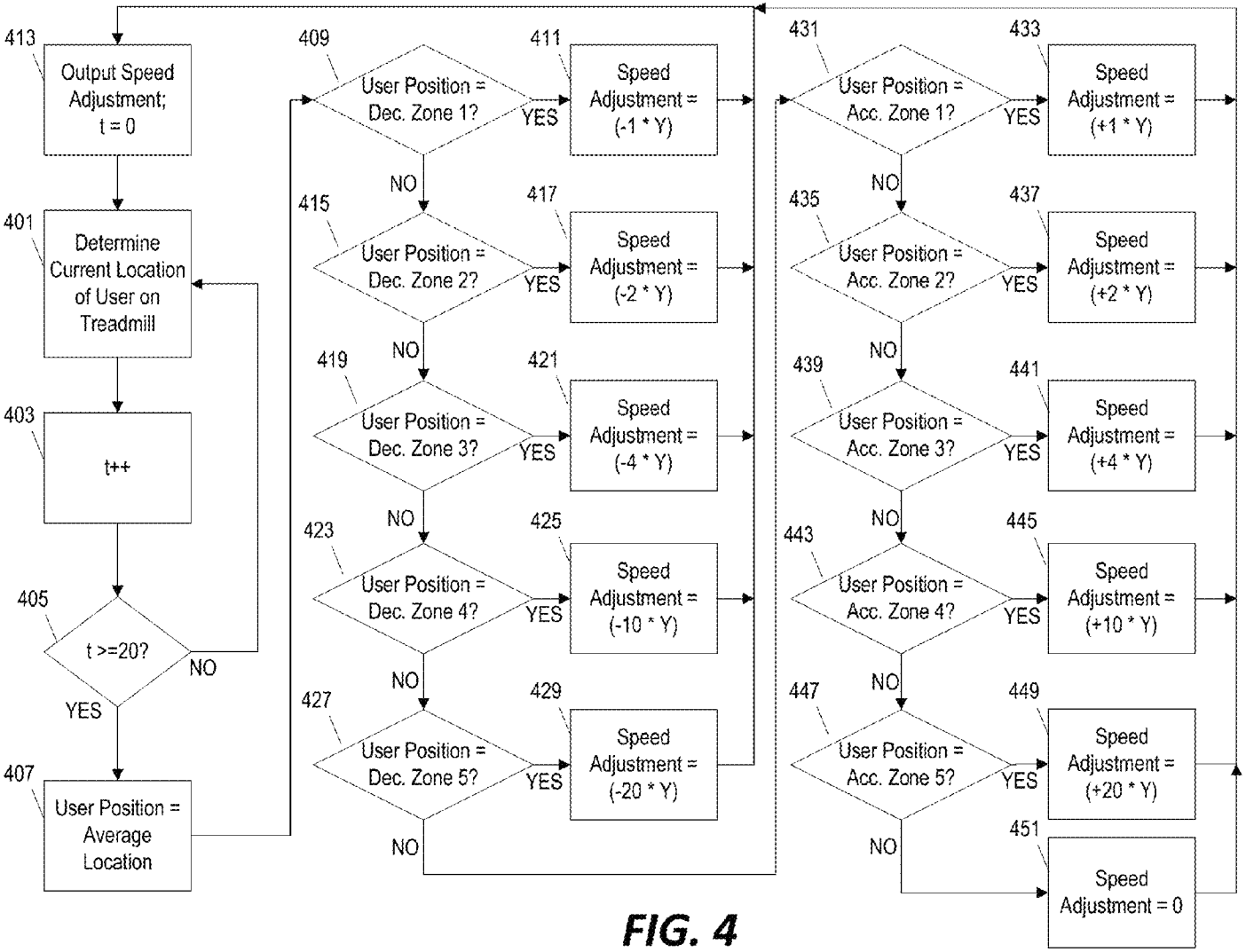
FIG. 4 is another flow chart of method for determining a speed adjustment for the treadmill control system of FIG. 1.

FIG. 4 illustrates a more detailed example of a mechanism used to identify and output a speed adjustment command based on an identified operating zone. First, the system determines a location of the user (step 401) based on the output of the sonar range finder and increments a counter (step 403). This is repeated until 20 location readings are received (step 405). The system then computes an average of the 20 location readings and uses this average as the position of the user for the purposes of this speed adjustment (step 407). If the average location indicates that the user is in the first deceleration zone (i.e., between the middle zone and the second deceleration zone) (step 409), then the system sets the speed adjustment as the negative speed adjustment corresponding to the first deceleration zone (step 411) and outputs the speed adjustment to the treadmill controller (step 413).

If the average location indicates that the user is in the second deceleration zone (i.e., between the first deceleration zone and the third deceleration zone) (step 415), then the system outputs a negative speed adjustment corresponding to the second deceleration zone (step 417). If the average location indicates that the user is in the third deceleration zone (i.e., between the second deceleration zone and the fourth deceleration zone) (step 419), then the system outputs a negative speed adjustment corresponding to the third deceleration zone (step 421). If the average location indicates that the user is in the fourth deceleration zone (i.e., between the third deceleration zone and the fifth deceleration zone) (step 423), then the system outputs a negative speed adjustment corresponding to the fourth deceleration zone (step 425). If the average location indicates that the user is in the fifth deceleration zone (i.e., between the fourth deceleration zone and the end of the fifth deceleration zone) (step 427), then the system outputs a negative speed adjustment corresponding to the fifth deceleration zone (step 429).

Similarly, if the system determines that the user is in the first acceleration zone (i.e., between the middle zone and the second acceleration zone) (step 431), then the system outputs a positive speed adjustment corresponding to the first acceleration zone (step 433). If the system determines that the user is in the second acceleration zone (i.e., between the first acceleration zone and the third acceleration zone) (step 435), then the system outputs a positive speed adjustment corresponding to the second acceleration zone (step 437). If the system determines that the user is in the third acceleration zone (i.e., between the second acceleration zone and the fourth acceleration zone) (step 439), then the system outputs a positive speed adjustment corresponding to the third acceleration zone (step 441). If the system determines that the user is in the fourth acceleration zone (i.e., between the third acceleration zone and the fifth acceleration zone) (step 443), then the system outputs a positive speed adjustment corresponding to the fourth acceleration zone (step 445). If the system determines that the user is in the fifth acceleration zone (i.e., between the fourth acceleration zone and an end of the fifth acceleration zone) (step 447), then the system outputs a positive speed adjustment corresponding to the fifth acceleration zone (step 449).

Finally, if the system is unable to determine that the user is positioned in one of the five defined acceleration zones or one of the five defined deceleration zones, then they system outputs a speed adjustment command of 0 km/h to the treadmill (step 451). As such, the speed adjustment output command will be set to zero if the user is already consistently operating in the "middle" zone. The speed adjustment command will also be 0 km/h if the sonar is unable to reliably detect a location of the user or if the output of the sonar indicates that the user is beyond the extreme limits of the defined zones (for example, beyond the front edge of the treadmill or off the rear edge). As such readings are likely erroneous (or indicative of some improper operation of the treadmill), the system in this example is configured to output a "0" speed adjustment to avoid drastic changes in speed due to erroneous readings or fault conditions.

As discussed above in reference to FIG. 1, the actual value of each speed adjustment command may be set based on factors such as, for example, the current speed of the treadmill belt and user preference. In the example of FIG. 4, the speed adjustment for the first deceleration zone (i.e., the nearest zone in front of the "middle" zone) is shown as −1*Y, the speed adjustment for the second deceleration zone is shown as −2*Y, and so on. In this terminology, "Y" represents a speed adjustment factor that is can be defined as a constant or can be made variable (based, for example, on the current speed of the treadmill). As such, if, for example, the speed adjustment factor is reduced due to the current operating speed of the treadmill, each speed adjustment command will be similarly reduced. Conversely, if the speed adjustment factor is increase, so is the magnitude of each speed adjustment command.

Furthermore, as also discussed above in reference to FIG. 1, in some implementations, the magnitude of the speed adjustment command is increased as the distance between the user's detected zone position and the "middle" zone increase. In various implementations, this can be provided, for example, as a linear increase or an exponential increase. For example, as shown in FIG. 4, the speed adjustment −1*Y for the first deceleration zone, −2Y for the second deceleration zone, −4Y for the third deceleration zone, −10Y for the fourth deceleration zone, and −20Y for the fifth deceleration zone. Therefore, if the speed adjustment factor is set at 0.16 km/h, the output speed adjustment would be −0.16 km/h for the first deceleration zone, −0.32 km/h for the second deceleration zone, −0.64 for the third deceleration zone, −1.6 km/h for the fourth deceleration zone, and −3.2 km/h for the fifth deceleration zone.

Figure 5:
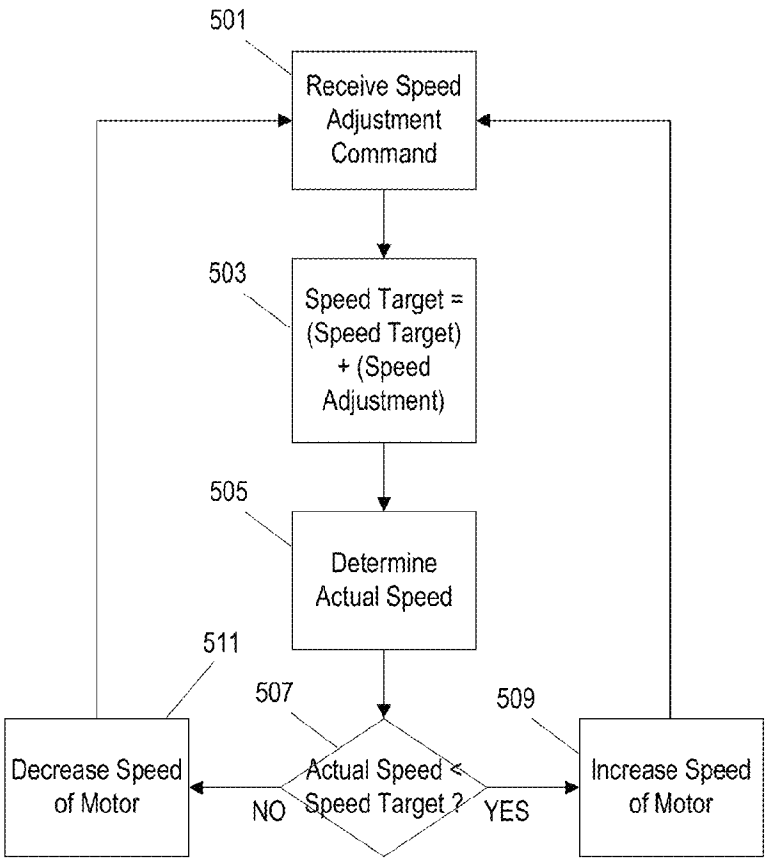
FIG. 5 is a flowchart of one method for adjusting the speed of a treadmill for the treadmill control system of FIG. 1 based on a speed adjustment output as determined, for example, by the methods of FIG. 3 or FIG. 4.

FIG. 5 illustrates a "speed target" feedback mechanism for applying the speed adjustment command from a method such as, for example, FIG. 3 or 4 to realize a change in the speed of the treadmill belt. The treadmill controller tracks a "speed target" and continually adjusts the operation of the treadmill motor(s) to cause the actual speed of the treadmill to approach the speed target. The treadmill controller receives an incremental speed adjustment command (step 501) and adjusts a current "speed target" based on the incremental command (step 503). For example, if the current speed target is 10 km/h and the received speed adjustment command is −1.6 km/h, the treadmill controller adjusts the target speed of the treadmill to 8.4 km/h (i.e., 10 km/h−1.6 km/h). The system then continues its standard feedback/adjustment routine by determining an actual speed of the treadmill belt (step 505) and, if the actual speed is less than the new "speed target" (step 507), increasing the speed of the treadmill motor (step 509). Conversely, if the actual speed is greater than the new "speed target," the speed of the treadmill motor is decreased accordingly (step 411).

In some implementations, a proportional (or PID) control mechanism is used to provide a gradual speed transition based on the difference between the actual speed and the target speed. For example, the controller may increase the speed of the treadmill motor at a relatively large acceleration if the difference between the actual speed and the target speed is also relatively large. In contrast, if the difference between the actual speed and the target speed is relatively small, the acceleration/deceleration applied by the treadmill controller will be similarly smaller. This reduces the perceptible amount of "jerky" operation caused by drastic and repeated speed changes.

Another way in which various implementation of the treadmill control system as described herein reduce the amount of perceptible "jerk," is by implementing a structured delay between speed adjustment commands sent to the treadmill controller. For example, although the averaging of the readings in the examples of FIGS. 3 and 4 does provide a more representative value of the location of the individual on the belt, it also creates a "built-in" delay in that only one speed adjustment command is sent to the treadmill controller for each 20 location readings received from the sonar range finder. This built-in delay prevents the software and treadmill from getting "backed up." In other words, the treadmill is given time to implement a speed change that may result in a change in the position of the user before a series of new readings become "queued" for processing. Having the system backed-up with too many readings/commands may prevent the system from responding to the most current commands. For example, without some delay mechanism built into the speed adjustment, the treadmill may be forced to respond to a series of acceleration commands that overshoot the ideal "target speed" forcing the user to move from an acceleration zone to a deceleration zone (and, perhaps, repeatedly back and forth without ever reaching the "middle" zone).

Figure 6:
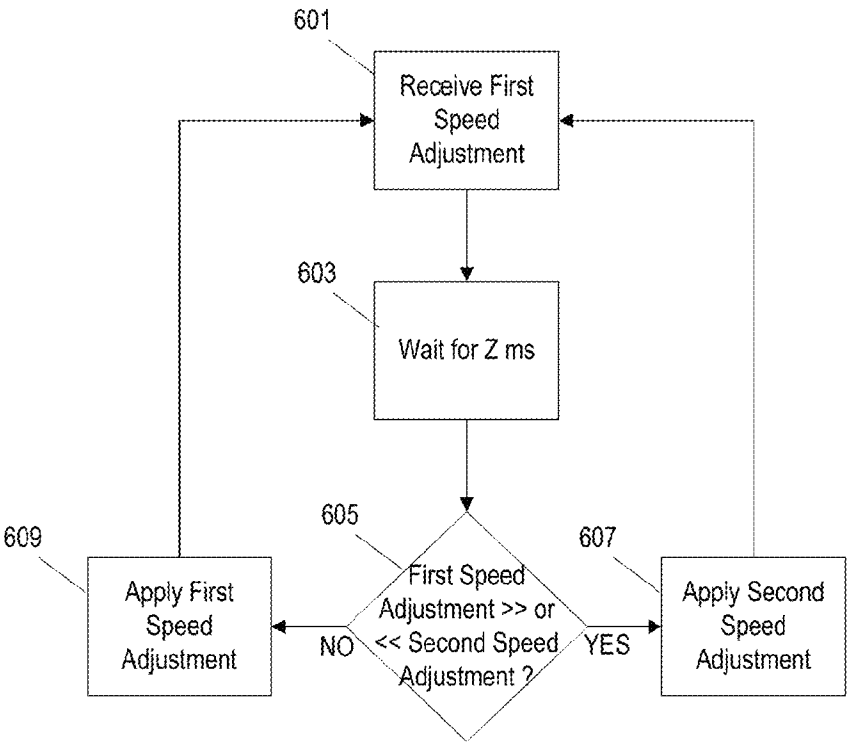
FIG. 6 is a flowchart of another method for adjusting the speed of a treadmill for the treadmill control system of FIG. 1 based on a speed adjustment output as determined, for example, by the methods of FIG. 3 or FIG. 4.

Another way to account for "back-up" in speed adjustment commands that may be implemented instead of or in addition to the "averaging" steps of FIGS. 3 and 4 and the continuous "speed target" adjustment of FIG. 5 is to implement a mechanism that allows certain speed adjustments commands to "leap-frog" other commands. One example of such a "command skipping" mechanism is illustrated in FIG. 6. The treadmill controller receives a first speed adjustment command (step 601) and waits for a delay period before executing the command (step 603). This delay may be a structured delay (i.e., the system waits 1 second after receiving each command before executing the command) or an unstructured delay due to the "back-up" of speed adjustment commands. In either case, one or more additional subsequent speed adjustment commands are received by the controller and queued before the first speed adjustment command is executed. While waiting to process the speed adjustment commands, the controller monitors the magnitude and direction of the speed adjustment commands in the queue. If a subsequently received speed adjustment command is significantly greater than or significantly less than an earlier received speed adjustment command (step 605), the controller will skip ahead to apply the subsequent speed adjustment command (step 607). If the subsequent commands are not significantly different, then the controller will continue to process the speed adjustment commands in the order in which they were received (step 609).

As a practical example, consider a user that has briefly moved from a steady running pace to a brief sprint and returns to an even slower walking pace after sprinting. The increase in speed due to the sprint may cause the user to move into one of the extreme acceleration zones and multiple relatively large speed increase commands would be sent to the treadmill controller. However, once the user stops sprinting, he would move quickly to one of the deceleration zones and the speed of the treadmill belt would need to be lowered quickly to move the user to the middle zone (and to ensure that the user does not fall off the back edge of the belt). If each command must be executed in order, the treadmill controller may continue to increase the speed of the belt even after the user has stopped running. However, using the method of FIG. 6, the treadmill recognizes a substantial difference between the subsequent "deceleration" command and the earlier "acceleration" command and is able to respond more quickly by skipping ahead to the deceleration command.

As noted above, the automatic speed adjustment features of this technology may be implemented as part of a single treadmill system or can be provided as a retro-fit kit that is installed on or near an existing treadmill system. The mechanisms discussed in FIGS. 3-6 for reducing perceptible "jerk" due to frequent—and sometime substantial—changes in speed may be particularly relevant to situations where the technology is implemented as a retro-fit or incorporated into an existing treadmill system. The motors of some currently available treadmill systems lack sufficient power to provide quick and smooth responsiveness to changes in speed. As such, depending on the specifications of the treadmill motor system used and other mechanical factors such as, for example, the mechanical linkages between the motor and the treadmill belt, the length of the delay period and/or the threshold used to determine whether to skip a speed adjustment command in favor of a subsequent command can be tuned to improve the perceived "smoothness" of speed transitions for the specific treadmill and for specific usage applications (e.g., sprinting or "walk desk" systems).

For other implementations (e.g., for new stand-alone treadmill systems designed specifically to operate with the automated speed adjustment technology described herein), perceptible jerk due to frequent speed changes may be further reduced by mechanical characteristics of the treadmill system. For example, the treadmill can be designed to include a higher-powered motor that is more responsive to changes in speed while driving the belt as well as including a more stable linkage mechanism between the treadmill belt and the motor drive to reduce slippage of the treadmill belt during relative large speed changes. Furthermore, the length of the treadmill belt and the running platform may be extended beyond that of a typical treadmill to allow for more zones and to provide the user with an increased comfort level while changing speeds (e.g., so that the user is not concerned about fall off or overrunning the treadmill belt).

Thus, the invention provides, among other things, a system for automatically adjusting the speed of a treadmill based on detected information about the location of the user on the treadmill, reducing perceptible jerk due to frequent speed adjustments, and for increasing responsiveness of the automatic speed adjustments. Various features and advantages of the invention are set forth in the following claims.

What is claimed is:

1. An automatic speed-adjusting treadmill system comprising:

a position sensor configured to output a signal indicative of a location of a user on a treadmill belt;

a processor; and a memory storing instructions that, when executed by the processor, cause the treadmill system to periodically determine the location of the user relative to a middle zone on the treadmill belt based on the output of the position sensor, determine a speed adjustment command based on an average of a defined number of the periodically determined locations of the user, wherein a magnitude of the speed adjustment command is greater for identified locations further from the middle zone, define an updated target speed for the treadmill belt based at least in part on the speed adjustment command, and adjust a speed of the treadmill belt based on the updated target speed;

wherein the instructions, when executed by the processor, cause the treadmill system to adjust the speed of the treadmill motor by:

queuing a plurality of speed adjustment commands for processing, monitoring a magnitude and a direction of queued speed adjustment commands, and skipping to a subsequent speed adjustment command if the magnitude or direction of the subsequent speed adjustment command is different than the magnitude or direction of an earlier queued speed adjustment command.

2. The automatic speed-adjusting treadmill system of claim 1, wherein the instructions, when executed by the processor, cause the treadmill system to determine the speed adjustment command based on an identified zone of a plurality of zones corresponding to the determined location of the user, the plurality of zones including the middle zone, one or more deceleration zones located on a first side of the middle zone, and one or more acceleration zones located on a second side of the middle zone opposite the first side, wherein a corresponding speed adjustment command is defined for each of the plurality of zones.

3. The automatic speed-adjusting treadmill system of claim 2, wherein the instructions, when executed by the processor, cause the automatic speed-adjusting treadmill system to dynamically change the speed adjustment command corresponding to at least one zone of the plurality of zones based on a current speed of the treadmill belt.

4. The automatic speed-adjusting treadmill system of claim 2, wherein the plurality of zones includes two or more deceleration zones arranged linearly on the first side of the middle zone and two or more acceleration zones arranged linearly on the second side of the middle zone, and wherein the corresponding speed adjustment command is greater in zones located further from the middle zone.

5. The automatic speed-adjusting treadmill system of claim 2, wherein the instructions, when executed by the processor, cause the treadmill system to dynamically alter the number of zones in the plurality of zones and to correspondingly adjust a size of at least one zone of the plurality of zones based on a current speed of the treadmill belt such that the number of zones in the plurality of zones increases as the current speed of the treadmill belt increases.

6. The automatic speed-adjusting treadmill system of claim 2, wherein the instructions, when executed by the processor, further cause the treadmill system to calculate an average position of the user based on periodic outputs from the position sensor;

determine a zone of the plurality of zones corresponding to the calculated average position of the user; and determine the speed adjustment command by determining the speed adjustment command corresponding to the determined zone for the calculated average position of the user.

7. The automatic speed-adjusting treadmill system of claim 1, wherein the instructions when executed by the processor, cause the treadmill system to perform an initialization routine that includes defining a location of the middle zone based on a detected location of the user on the treadmill belt during the initialization routine.

8. The automatic speed-adjusting treadmill system of claim 1, wherein the position sensor includes an optical range sensor positionable to detect the location of the user on the treadmill belt.

9. The automatic speed-adjusting treadmill system of claim 1, wherein the instructions, when executed by the processor, cause the treadmill system to determine the speed adjustment command by determining a speed adjustment magnitude based on the determined location of the user and a current speed of the treadmill motor.

10. The automatic speed-adjusting treadmill system of claim 1, wherein the instructions, when executed by the processor, cause the treadmill system to define an updated target speed for the treadmill belt by adding the determined speed adjustment command and a current speed of the treadmill belt.

11. The automatic speed-adjusting treadmill system of claim 1, wherein the instructions, when executed by the processor, cause the treadmill system to define an updated target speed for the treadmill belt by adding the determined speed adjustment command and a current target speed for the treadmill belt.

12. A method of automatically adjusting a speed of a treadmill based on a position of a user on a treadmill belt, the method comprising:

periodically determining a location of the user relative to a middle zone on the treadmill belt based on an output of a position sensor, determining a speed adjustment command based on an average of a defined number of the periodically determined locations of the user, wherein a magnitude of the speed adjustment command is greater for identified locations further from the middle zone, defining an updated target speed for the treadmill belt based at least in part on the speed adjustment command, and adjusting a speed of the treadmill belt based on the updated target speed; wherein adjusting the speed of the treadmill motor includes:

queuing a plurality of speed adjustment commands for processing, monitoring a magnitude and a direction of queued speed adjustment commands, and skipping to a subsequent speed adjustment command if the magnitude or direction of the subsequent speed adjustment command is significantly different than the magnitude or direction of an earlier queued speed adjustment command.

13. The method of claim 12, further comprising identifying a zone of a plurality of zones corresponding to the determined location of the user, the plurality of zones including the middle zone, one or more deceleration zones located on a first side of the middle zone, and one or more acceleration zones located on a second side of the middle zone opposite the first side, wherein a corresponding speed adjustment factor is defined for each of the plurality of zones.

14. The method of claim 13, further comprising dynamically changing the speed adjustment command corresponding to at least one zone of the plurality of zones based on a current speed of the treadmill belt.

15. The method of claim 13, further comprising dynamically altering the number of zones in the plurality of zones and correspondingly adjusting a size of at least one zone of the plurality of zones based on a current speed of the treadmill belt such that the number of zones in the plurality of zones increases as the current speed of the treadmill belt increases.

16. The method of claim 12, wherein determining the speed adjustment command includes determining a speed adjustment magnitude based on the determined location of the user and a current speed of the treadmill motor.

17. The method of claim 12, wherein defining an updated target speed for the treadmill belt includes adding the determined speed adjustment command and a current speed of the treadmill belt to calculate the updated target speed.

18. The method of claim 12, wherein defining an updated target speed for the treadmill belt includes adding the determined speed adjustment command and a current target speed for the treadmill belt to calculate the updated target speed.

* * * * *